US008915111B2

(12) United States Patent
Ko

(10) Patent No.: US 8,915,111 B2
(45) Date of Patent: Dec. 23, 2014

(54) DIE APPARATUS USING IMMERSION COOLING

(75) Inventor: Kang-Hee Ko, Seoul (KR)

(73) Assignee: Hyundai Steel Company, Icheon (KR)

( * ) Notice: Subject to any disclaimer, the term of this patent is extended or adjusted under 35 U.S.C. 154(b) by 470 days.

(21) Appl. No.: 13/376,583

(22) PCT Filed: Dec. 28, 2010

(86) PCT No.: PCT/KR2010/009450

§ 371 (c)(1),
(2), (4) Date: Dec. 6, 2011

(87) PCT Pub. No.: WO2011/093596

PCT Pub. Date: Aug. 4, 2011

(65) Prior Publication Data

US 2012/0073349 A1 Mar. 29, 2012

(30) Foreign Application Priority Data

Jan. 27, 2010 (KR) ..... 10-2010-0007596
Dec. 28, 2010 (KR) ..... 10-2010-0136319

(51) Int. Cl.
*B21D 37/16* (2006.01)
*C21D 1/673* (2006.01)
*B22D 17/22* (2006.01)

(52) U.S. Cl.
CPC ..... *B22D 17/2218* (2013.01); *B21D 37/16* (2013.01); *C21D 1/673* (2013.01)
USPC ..... 72/342.3; 148/646

(58) Field of Classification Search
USPC ..... 72/342.1–342.3, 342.7; 148/646, 647
See application file for complete search history.

(56) References Cited

U.S. PATENT DOCUMENTS

| | | | | |
|---|---|---|---|---|
| 1,346,946 | A * | 7/1920 | Fay | 148/646 |
| 3,585,836 | A * | 6/1971 | Tate et al. | 72/384 |
| 7,266,982 | B1 | 9/2007 | Guza | |
| 2007/0017272 | A1 | 1/2007 | Kurisu et al. | |
| 2008/0289393 | A1 | 11/2008 | Lee | |

FOREIGN PATENT DOCUMENTS

| | | | |
|---|---|---|---|
| DE | 102005028010 | B3 | 7/2006 |
| DE | 102007019173 | B3 | 5/2008 |
| KR | 10-0719760 | B1 | 5/2007 |
| KR | 10-0753714 | B1 | 8/2007 |
| KR | 10-0907225 | B1 | 7/2009 |

OTHER PUBLICATIONS

International Search Report dated Jul. 26, 2011 of PCT/KR2010/009450—3 pages.
Written Opinion dated Jul. 26, 2011 of PCT/KR2010/009450—3 pages.

* cited by examiner

*Primary Examiner* — Debra Sullivan
(74) *Attorney, Agent, or Firm* — Knobbe, Martens, Olson & Bear, LLP

(57) ABSTRACT

The present invention relates to a die apparatus which cools metals after hot pressing. More specifically, the present invention relates to an immersion cooling type die apparatus, in which dies are immersed in a coolant to enhance a cooling rate of the dies while guaranteeing uniform quality. The die apparatus includes an upper die having a pressing surface formed on a lower surface thereof, a lower die having a pressing surface formed on an upper surface thereof, a coolant bath storing a predetermined level of coolant, and a pressing unit driven to lower and compress the upper die onto the lower die, to lower both the upper and lower dies in a compressed state, and to lift the upper and lower dies in a reverse sequence.

13 Claims, 6 Drawing Sheets

DIE APPARATUS USING IMMERSION COOLING

TECHNICAL FIELD

The present invention relates to a die apparatus which cools metals after hot pressing. More specifically, the present invention relates to an immersion cooling type die apparatus, in which dies are immersed in a coolant to enhance a cooling rate of the dies while guaranteeing uniform forming quality.

BACKGROUND ART

Generally, a steel sheet or steel pipe is subjected to pressing at high temperature and cooling when producing a vehicle component.

More specifically, a steel sheet or a steel pipe heated to high temperature is inserted into press dies and subjected to pressing to form a product having a desired shape simultaneously with rapid cooling of the formed product.

DISCLOSURE

Technical Problem

The present invention provides a die apparatus which includes a fine tube formed in an upper or lower die and extending from a side surface of the upper or lower die to a pressing surface thereof to allow a coolant to be efficiently transferred to a front side of the die to cool the dies during a press operation.

Further, the present invention provides a die apparatus, which includes a fine tube formed in an upper or lower die and extending from a side surface of the upper or lower die to a pressing surface thereof to be formed on the pressing surface such that a coolant can be brought into direct contact with a surface of a formed product through the fine tube, and which allows the dies to be lifted upon release of a pressing operation such that the coolant can be naturally discharged therefrom, thereby enhancing cooling efficiency.

Technical Solution

In accordance with an aspect of the present invention, a die apparatus includes an upper die having a pressing surface formed on a lower surface thereof; a lower die having a pressing surface formed on an upper surface thereof; a coolant bath storing a predetermined level of coolant; and a pressing unit driven to lower and compress the upper die onto the lower die, to lower both the upper and lower dies in a compressed state, and to lift the upper and lower dies in a reverse sequence.

The coolant level of the coolant bath may be maintained to prevent the lower die from being immersed into the coolant before the upper die is compressed onto the lower die, and to allow both the upper and lower dies to be immersed into the coolant when the compressed upper and lower dies are lowered.

The upper or lower die may be provided with a fine tube extending from an outer surface thereof to the pressing surface thereof, and the fine tube may have a diameter of 0.1 to 10 mm.

The fine tube may have a downward gradient to allow the coolant to be naturally discharged from the upper or lower die therethrough when the upper die or the lower die is lifted above the coolant bath.

The die apparatus may further include a compressed-air jet unit which injects compressed air towards the pressing surface of the upper or lower die.

The pressing unit may include a bottom plate secured to the bottom surface of the coolant bath; a middle plate coupled to the lower die and connected to the bottom plate to move upwards or downwards; and an upper plate coupled to an upper die and connected to the middle plate to move upwards or downwards.

The coolant bath may be configured to allow the coolant to flow in a predetermined direction therein.

The coolant bath may include a supply tube through which the coolant is supplied to the coolant bath; a recovery tube through which the coolant is recovered from the coolant bath; a pump connected between the recovery tube and the supply tube to force the coolant to be transferred through the recovery tube; a filter disposed between the recovery tube and the supply tube to remove foreign matter from the coolant; and a cooling unit disposed between the recovery tube and the supply tube to cool the coolant.

The supply tube and the recovery tube may be respectively formed on opposite surfaces of the coolant bath to provide a predetermined flow of the coolant in the coolant bath.

The apparatus may further include a horizontal shifting unit which shifts the upper die in a horizontal direction to prevent the coolant from falling from the upper die onto the lower die.

Advantageous Effects

According to exemplary embodiments of the invention, the immersion cooling type die apparatus includes a capillary tube connecting an outer surface of an upper or lower die to a pressing surface thereof, such that a product can be immersed in a coolant in a state of being compressed between the upper and lower dies, thereby enabling uniform cooling of the product.

Further, the immersion cooling type die apparatus according to the embodiments allows a coolant to be naturally discharged from the upper or lower die when the upper and lower dies are lifted after completion of cooling, so that the coolant does not remain in the dies.

MODE FOR INVENTION

Figure 1:
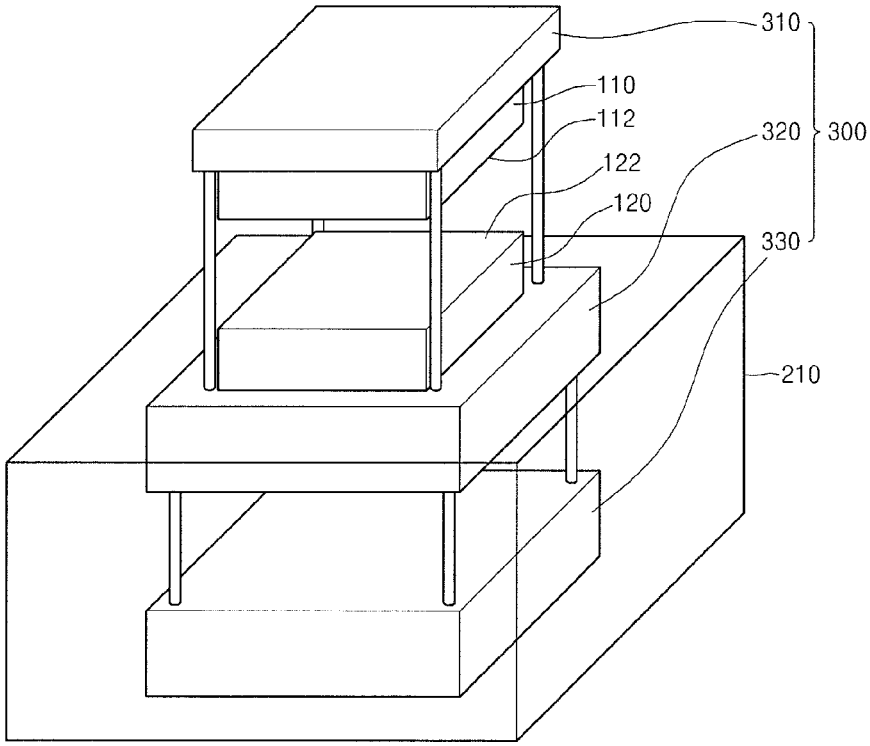
FIG. 1 is a diagram of an immersion cooling type die apparatus according to a first embodiment of the present invention.

The present invention may achieve uniform cooling of a formed product upon injection of a coolant to dies while facilitating removal of the coolant from the dies.

Particularly, the present invention provides a method of cooling press dies, which allows the press dies to be easily cooled during a forming operation without a separate process and enables cooling a bent portion of a pressed component, which is difficult to cool via a general cooling process.

Exemplary embodiments of the present invention will now be described in detail with reference to the accompanying drawings.

The above and other aspects, features, and advantages of the invention will become apparent from the detailed description of the following embodiments in conjunction with the accompanying drawings. It should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like components will be denoted by like reference numerals throughout the specification.

FIG. 1 is a diagram of an immersion cooling type die apparatus according to a first embodiment of the present invention The die apparatus includes an upper die 110 having an upper pressing surface 112 formed on a lower surface thereof; a lower die 120 having a lower pressing surface 122 formed on an upper surface thereof; a coolant bath 210 storing a predetermined level of coolant and having a size to allow the upper die 110 and the lower die 120 to be immersed therein; and a pressing unit 300 which is driven to lower and compress the upper die onto the lower die, to lower both the upper and lower dies in a compressed state, and to lift the upper and lower dies in a reverse sequence.

The pressing unit 300 includes a bottom plate 330 secured to a bottom surface of the coolant bath 210, a middle plate 320 coupled to the lower die and connected to the bottom plate 330 to move upwards or downwards, and an upper plate 310 coupled to an upper die and connected to the middle plate 320 to move upwards or downwards.

The coolant bath 210 is filled to a predetermined level with a coolant. Water, oil or the like may be used as the coolant, and suitable additives (rust-inhibitors and the like) may be added to the coolant.

Figure 2:
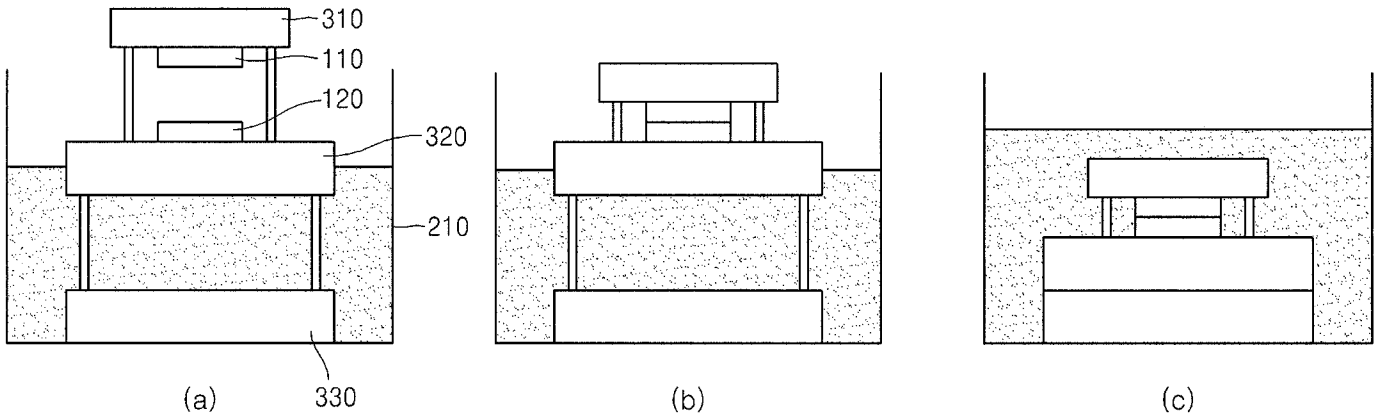
FIG. 2 is a diagram illustrating operation of the immersion cooling type die apparatus according to the first embodiment of the present invention.

The coolant level of the coolant bath 210 may be maintained to prevent the lower die 120 from being immersed in the coolant before the upper die 110 is compressed onto the lower die 120, and to allow both the upper and lower dies 110, 120 to be immersed in the coolant when the compressed upper and lower dies 110, 120 are lowered FIG. 2 is a diagram illustrating operation of the immersion cooling type die apparatus according to the first embodiment of the present invention.

In FIG. 2, (a) shows that the upper die 110 and the lower die 120 is lifted above the coolant. In this stage, a heated material 10 may be placed between the upper die 110 and the lower die 120.

(b) shows that the upper die 110 is lowered to compress the lower die 120, in which only the upper plate 310 of the pressing unit 300 is lowered. In this stage, press molding of the material 10 is completed.

(c) shows that the upper and lower dies 110, 120 are immersed in the coolant in a compressed state. In order to perform rapid cooling of the heated material after press molding, the material is immersed in the coolant in a state of being compressed between the upper die 110 and the lower die 120, and is thus rapidly cooled together with the dies.

After completing the rapid cooling, the dies are lifted in order of (b)->(a).

When the middle plate 320 is lifted to the state as shown in (b), the coolant is naturally discharged from the dies, and when the middle plate 320 is lifted to the state as shown in (a), the molded material is ejected from the dies and another target material is fed to the dies.

Figure 3:
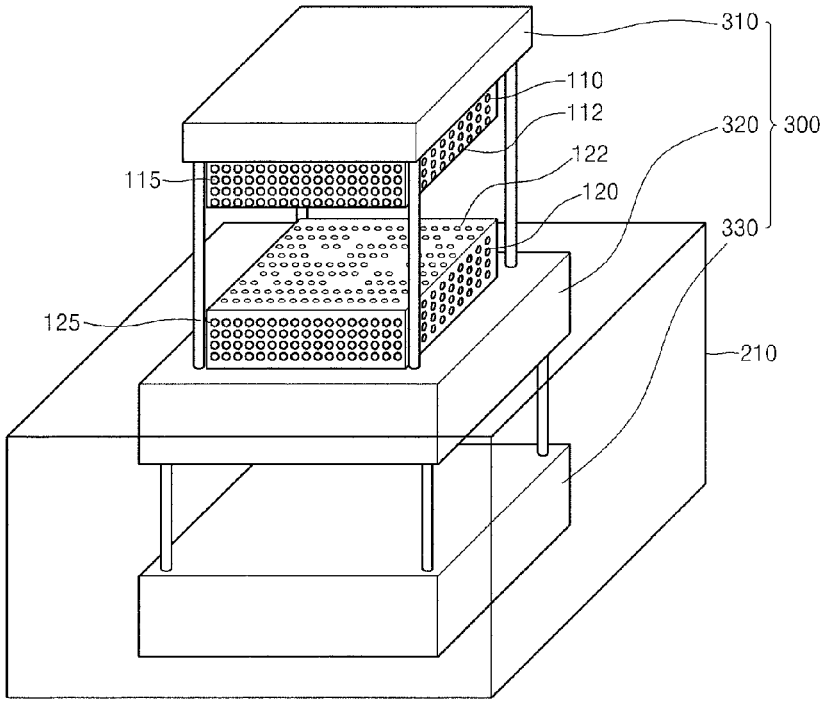
FIG. 3 is a diagram of an immersion cooling type die apparatus according to a second embodiment of the present invention.
Figure 4:
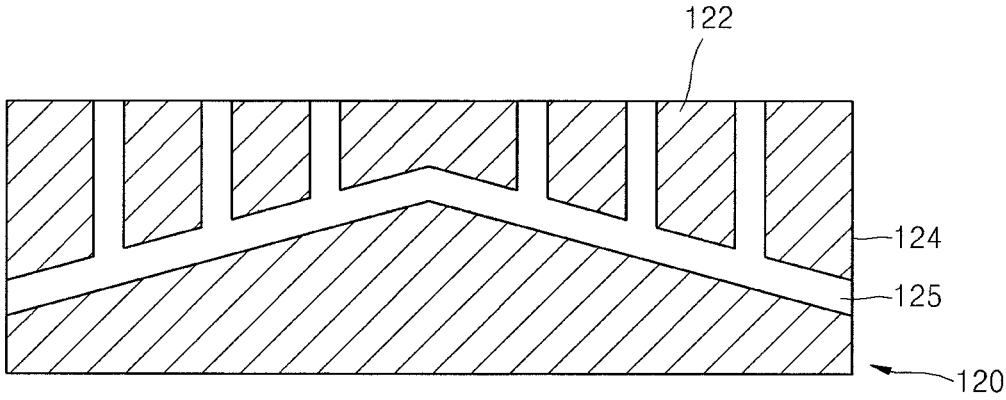
FIG. 4 is a cross-sectional view of a lower die having a fine tube formed therein.

FIG. 3 is a diagram of an immersion cooling type die apparatus according to a second embodiment of the present invention, and FIG. 4 is a cross-sectional view of a lower die having a fine tube formed therein.

According to this embodiment, fine tubes 115, 125 are formed in upper and lower dies 110, 120.

Each of the fine tubes is formed to connect an outer surface of the upper die 110 or the lower die 120 to a corresponding pressing surface 112 or 122, such that a coolant can be efficiently supplied directly to the surface of a material therethrough when the upper die 110 and the lower die 120 are immersed in the coolant.

The fine tubes 115, 125 respectively provided to the upper and lower dies 110, 125 are operated by the same principle and provide the same effects. Herein, the fine tube 125 of the lower die 120 will be described.

Referring to FIG. 4, the fine tube 125 is configured to connect an outer surface 124 of the lower die 120 to a pressing surface 122 thereof That is, the fine tube 125 provides a coolant path through which the coolant flowing into the outer surface 124 may be supplied to the pressing surface 122.

Since the size of the fine tube formed on the pressing surface 122 can influence surface quality of a formed product, the fine tube formed on the pressing surface 122 may have a diameter in the range of 0.1 to 10 mm.

If the fine tube 125 formed on the pressing surface 122 has a diameter less than 0.1 mm, the fine tube is likely to be blocked by floating particles or scales and efficient supply of the coolant can be difficult.

If the fine tube 125 formed on the pressing surface 122 has a diameter exceeding 10 mm, the shape of the fine tube is likely to be transferred to the surface of the formed product.

Further, the fine tube 125 may have a downward gradient towards the outer surface of the lower die to allow the coolant to be naturally discharged therefrom when the lower die 120 is lifted above the coolant bath.

When the coolant remains on the pressing surface 122, the coolant is likely to deteriorate surface quality of a subsequent material during a press operation. Thus, it is important to allow the coolant to be efficiently discharged from the lower die 120 when the lower die 120 is lifted.

According to one embodiment, the die apparatus may include a compressed air jet unit to achieve complete removal of the coolant with the upper and lower dies 110, 120 lifted above the coolant bath.

When the upper and lower dies 110, 120 are lifted above the coolant bath, the compressed air jet unit (not shown) injects compressed air towards the surfaces of the upper and lower dies 110, 120, thereby completely removing the coolant from the surfaces thereof.

Figure 5:
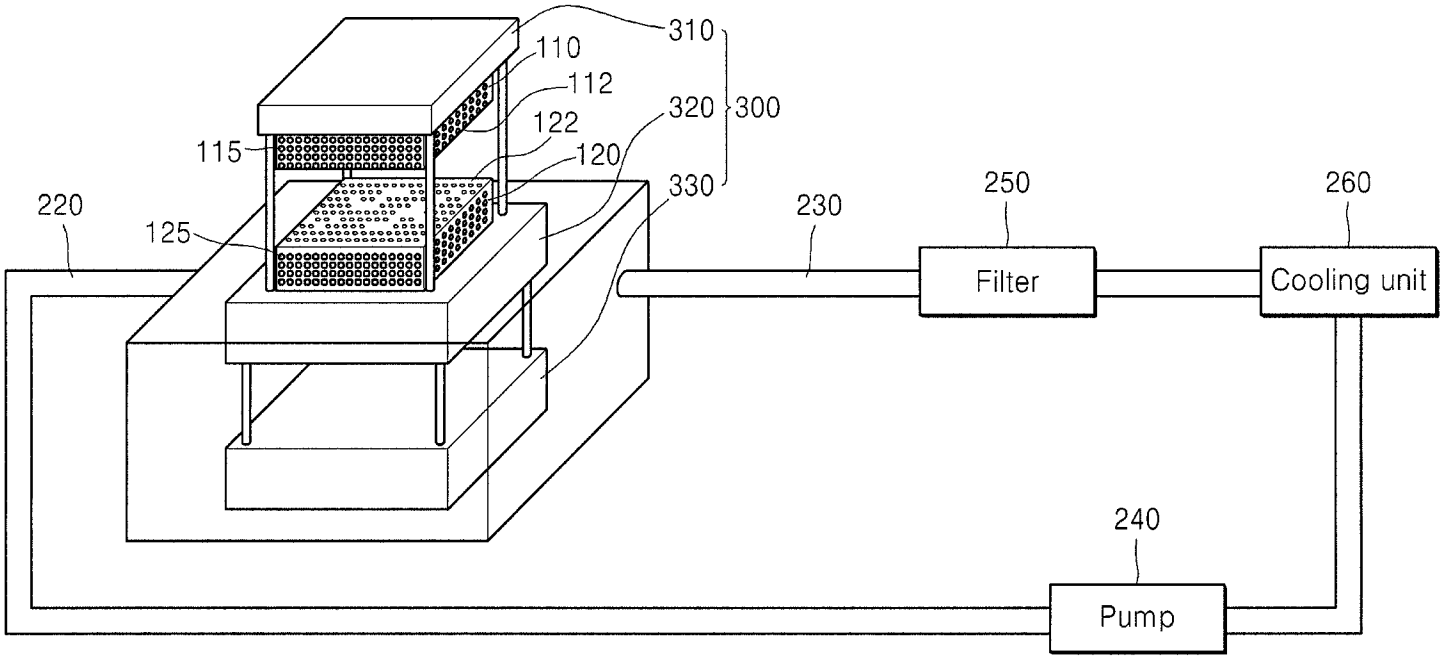
FIG. 5 is a diagram of an immersion cooling type die apparatus according to a third embodiment of the present invention.

FIG. 5 is a diagram of an immersion cooling type die apparatus according to a third embodiment of the present invention.

According to this embodiment, the die apparatus includes a coolant recycling system which circulates a coolant.

The die apparatus according to this embodiment includes: an upper die 110 having a pressing surface 112 formed on a lower surface thereof and including a fine tube connecting an outer surface of the upper die 110 to the pressing surface thereof, a lower die 120 having a pressing surface 122 formed on an upper surface thereof and including a fine tube connecting an outer surface of the lower die 120 to the pressing surface 122 thereof, a coolant bath 210 storing a predetermined level of coolant, a supply tube 220 through which the coolant is supplied to the coolant bath 210, a recovery tube 230 through which the coolant is recovered from the coolant bath 210, a pump 240 connected between the recovery tube 230 and the supply tube 220 to force the coolant to be recovered through the recovery tube 230, a filter 250 disposed between the recovery tube 230 and the supply tube 220 to remove foreign matter from the coolant, a cooling unit 260 disposed between the recovery tube and the supply tube to cool the coolant, and a pressing unit 300 disposed within the coolant bath and driven to lower and compress the upper die onto the lower die, to lower both the upper and lower dies in a compressed state, and to lift the upper and lower dies in a reverse sequence.

As the coolant stored in the coolant bath 210 cools a formed product and the dies 110, 120, the coolant increases in temperature. Thus, the coolant may be kept at a constant temperature in order to guarantee uniform cooling quality in a continuous process.

Further, since the coolant generally contains floating particles or scales, it is important to remove such foreign matter from the coolant in order to prevent deterioration of surface quality. Thus, the die apparatus according to this embodiment is provided with the filter 250 to remove foreign matter such as floating particles or scales from the coolant.

In addition, when the coolant stored in the coolant bath 210 flows in a certain direction to circulate continuously therein, it is possible to achieve more uniform cooling. Thus, according to this embodiment, the supply tube 220 for supplying the coolant is placed at an opposite side to the recovery tube 230 for recovering the coolant. Namely, the recovery tube 230 and the supply tube 220 are respectively formed on opposite sides of the coolant bath such that the coolant flows in a predetermined direction within the coolant bath 210.

The coolant is discharged from the coolant bath 210 through the recovery tube 230 and foreign matter is removed from the coolant while the coolant passes through the filter 250. Then, while passing through the cooling unit 260, the coolant is cooled to a predetermined temperature and is forced towards the coolant bath 210 through the supply tube 220 by the pump 240.

That is, the coolant may be kept at a constant temperature in a clean state while continuously circulating in the die apparatus.

Figure 6:
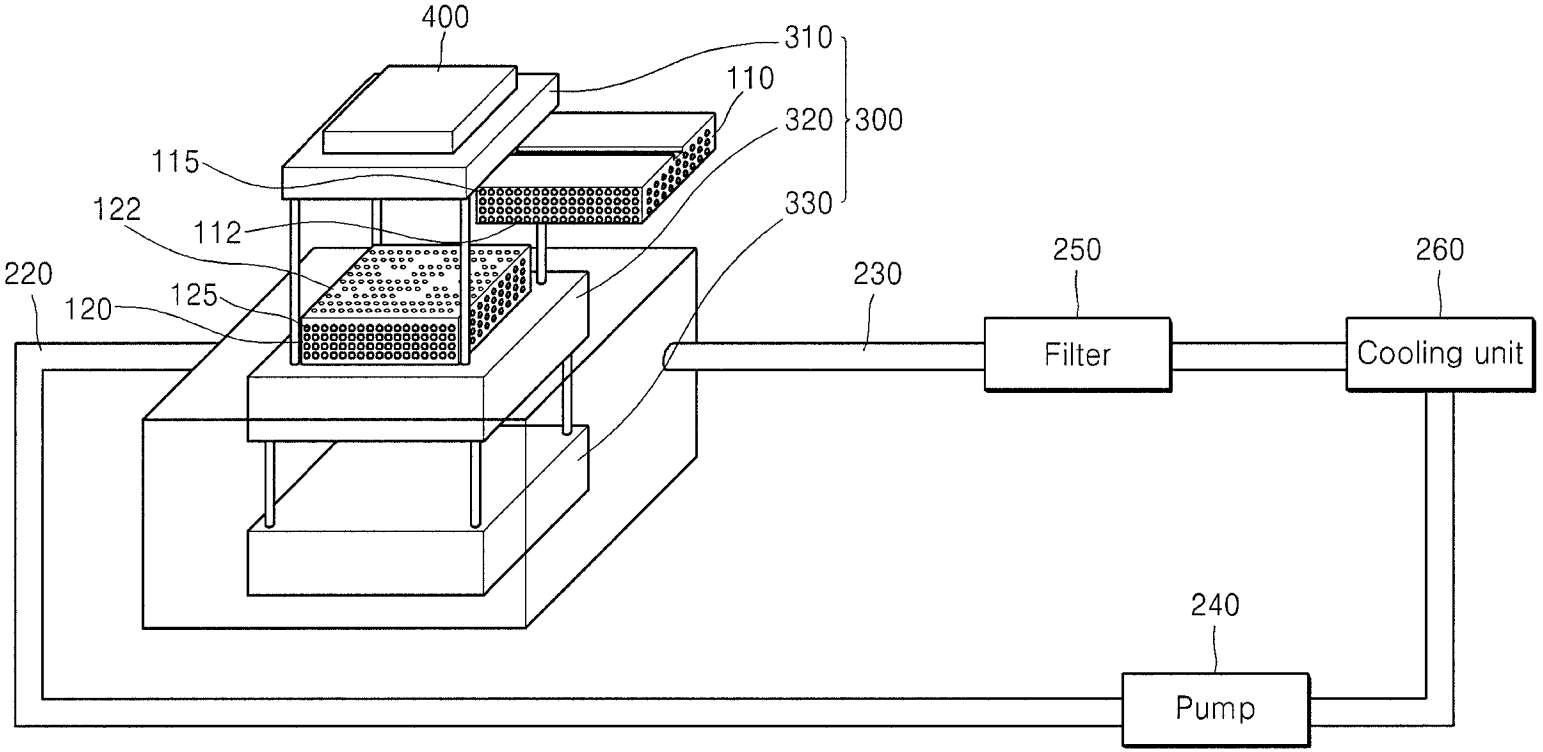
FIG. 6 is a diagram of an immersion cooling type die apparatus according to a fourth embodiment of the present invention.

FIG. 6 is a diagram of an immersion cooling type die apparatus according to a fourth embodiment of the present invention.

According to this embodiment, the upper die may be shifted in a horizontal direction. The die apparatus according to this embodiment further includes a horizontal shifting unit 400 which shifts the upper die 110 in the horizontal direction when the upper die 110 is lifted above the coolant bath. The horizontal shifting unit 400 is configured to reciprocate in the horizontal direction, and may be realized by a reciprocating cylinder capable of being reciprocated by hydraulic pressure or pneumatic pressure, a rack and pinion, a drive motor, and the like. Obviously, the horizontal shifting unit may be realized by other mechanical components.

When the upper die 110 is lifted above the coolant bath, the coolant is discharged from the upper die 110. Here, some of the coolant may fall on the lower die. In this case, since the coolant is likely to remain on the lower die, the die apparatus according to this embodiment allows the upper die 110 to be shifted in the horizontal direction using the shifting unit so that the upper die 110 is displaced from a place direct above the lower die 120.

When the upper die 110 is displaced from a place direct above the lower die 120, the coolant may be prevented from falling from the upper die to the lower die, thereby facilitating removal of a formed product and placement of a subsequent material in the dies.

Although some embodiments have been described herein, it should be understood by those skilled in the art that these embodiments are given by way of illustration only, and that various modifications, variations, and alterations can be made without departing from the spirit and scope of the invention. Therefore, the scope of the invention should be limited only by the following claims and equivalents thereof.

[Industrial Applicability]

The present invention relates to a die apparatus which enables rapid cooling after hot pressing through immersion type cooling to guarantee uniform cooling while achieving quality improvement of a formed product.

The invention claimed is:

1. A die apparatus comprising:

an upper die having a first pressing surface;

a lower die having a second pressing surface generally opposing the first pressing surface;

a coolant bath containing a coolant therein; and a driving mechanism configured to cause the upper die and the lower die to press a steel blank interposed between the upper die and the lower die to form a steel product, wherein the driving mechanism is further configured to move the upper die, the lower die and the steel product together into the coolant bath while the steel product is interposed between the upper die and the lower die, wherein at least one of the upper die and the lower die is provided with at least one coolant passage extending from an outer surface of the at least one of the upper and lower dies to at least one of the first and second pressing surfaces.

2. The die apparatus of claim 1, wherein the coolant bath contains the coolant at a level sufficient to submerge both the upper and lower dies.

3. The die apparatus of claim 1, wherein the at least one coolant passage comprises one or more openings formed through the first or second pressing surface, wherein the at least one coolant passage is configured to allow the coolant to reach the steel product via the one or more openings when at least one of the upper die and the lower die is submerged into the coolant.

4. The die apparatus of claim 3, wherein the coolant passage one or more openings formed through the first or second pressing surface has a diameter of 0.1 to 10 mm.

5. The die apparatus of claim 1, wherein the at least one coolant passage has a gradient to allow the coolant to be spontaneously discharged therefrom when the upper die or the lower die is lifted out of the coolant bath.

6. The die apparatus of claim 1, further comprising: a compressed-air injector configured to inject compressed air towards the first or second pressing surface.

7. The die apparatus of claim 1, wherein the driving mechanism comprises a bottom plate secured to a bottom surface of the coolant bath, a middle plate coupled to the lower die and connected to the bottom plate, and an upper plate coupled to the upper die and connected to the middle plate.

8. The die apparatus of claim 1, wherein the coolant bath is configured to flow the coolant in a predetermined direction therein.

9. The die apparatus of claim 1, wherein the coolant bath comprises:

a coolant supply tube configured to supply the coolant to the coolant bath;

a coolant recovery tube configured to discharge the coolant from the coolant bath;

a coolant pump connected between the coolant recovery tube and the coolant supply tube to circulate the coolant; and a coolant filter disposed between the coolant recovery tube and the coolant supply tube.

10. The die apparatus of claim 9, further comprising: a coolant cooler disposed between the coolant recovery tube and the coolant supply tube.

11. The die apparatus of claim 9, wherein the coolant supply tube and the coolant recovery tube are connected to the coolant bath at generally opposing surfaces of the coolant bath to cause a flow of the coolant in the coolant bath.

12. A die apparatus comprising:

an upper die having a first pressing surface and including a coolant channel with an opening through the first pressing surface;

a lower die having a second pressing surface and including a coolant channel with an opening through the second pressing surface thereof;

a coolant bath containing a coolant therein;

a coolant supply tube configured to supply the coolant to the coolant bath;

a coolant recovery tube configured to discharge the coolant is from the coolant bath;

a coolant pump connected between the coolant recovery tube and the coolant supply tube to circulate the coolant;

a coolant filter disposed between the coolant recovery tube and the coolant supply tube;

a coolant cooler disposed between the coolant recovery tube and the coolant supply tube; and a driving mechanism configured to cause the upper die and the lower die to press a steel blank interposed between the upper die and the lower die to form a steel product, wherein the driving mechanism is further configured to move the upper die, the lower die and the steel product together into the coolant bath while the steel product is interposed between the upper die and the lower die.

13. The die apparatus of claim 12, wherein the driving mechanism is further configured to shift the upper die in a horizontal direction.

* * * * *